US006355073B1

(12) United States Patent
Godau

(10) Patent No.: US 6,355,073 B1
(45) Date of Patent: Mar. 12, 2002

(54) METHOD AND DEVICE FOR CONTINUOUS DYEING OF WARP ENDS

(75) Inventor: Eckhardt Godau, Canobbio (CH)

(73) Assignee: Gullshield Ltd., Dublin (IE)

( * ) Notice: Subject to any disclaimer, the term of this patent is extended or adjusted under 35 U.S.C. 154(b) by 0 days.

(21) Appl. No.: 09/402,572

(22) PCT Filed: Oct. 2, 1997

(86) PCT No.: PCT/IB97/01191

§ 371 Date: Oct. 1, 1999

§ 102(e) Date: Oct. 1, 1999

(87) PCT Pub. No.: WO98/45521

PCT Pub. Date: Oct. 15, 1998

(30) Foreign Application Priority Data

Apr. 4, 1997 (EP) ..... 97105573

(51) Int. Cl.[7] ..... D06B 3/06

(52) U.S. Cl. ..... 8/149.1; 8/151.2; 8/158; 68/5 E

(58) Field of Search ..... 8/149.1, 151, 151.2, 8/158; 68/5 E

(56) References Cited

U.S. PATENT DOCUMENTS 2,441,991 A * 5/1948 Converse et al. ..... 68/5 E
2,441,992 A * 5/1948 Converse ..... 68/5 E
3,981,680 A 9/1976 Fletcher
4,182,142 A * 1/1980 Sando et al. ..... 68/5 E
4,262,377 A * 4/1981 Sando et al. ..... 8/149.1
4,275,575 A * 6/1981 Schiffer ..... 68/5 E

FOREIGN PATENT DOCUMENTS

DE 42 43 313 A1 6/1995
EP 0 361 098 4/1990
GB 2075073 A * 11/1981 ..... 68/5 E

* cited by examiner

*Primary Examiner*—Philip R. Coe
(74) *Attorney, Agent, or Firm*—Herbert Dubno

(57) ABSTRACT

The invention relates to a method for the continuous dyeing of warp ends, in particular cotton warp ends, with indigo or other dyestuff groups which, after impregnating and squeezing out, require oxidation or thermal treatment for fixing. The method eliminates the disadvantages of traditional methods for the continuous dyeing of warp ends. In particular, the required bath amount is considerably reduced by this method. By using a new dyeing reactor (1), the residence time of the warp ends in the dyeing installation can be varied without having to increase the bath volume. The option of heating or cooling the dyeing bath enables a fixing temperature between below room temperature and over 100° C. to be chosen. Optimal conditions can thus be created for all dyeing methods which are habitual for warp ends. In this way, the number of immersion-oxidation processes in the indigo dyehouse can be reduced and the growing demand for indigo blue jeans material with different wash resistances and shades can thus be catered for with increased flexibility. And the same can be done for black and colored denim.

21 Claims, 4 Drawing Sheets

METHOD AND DEVICE FOR CONTINUOUS DYEING OF WARP ENDS

CROSS REFERENCE TO RELATED APPLICATION

This application is a national stage of PCT/IB97/01191 filed Oct. 20, 1997 and based upon EP 97/05573.6 filed Apr. 4, 1997 under the International Convention.

FIELD OF THE INVENTION

This invention relates to a process for the continuous dyeing of warp yarn, particularly cotton warp yarn, with indigo or with other groups of dyestuffs, which after impregnation and squeezing-off, require oxidation or heat treatment for development and fixation.

BACKGROUND OF THE INVENTION

Continuous warp dying machines for the indigo dyeing of blue denim are known, which consist of connected dyeing vessels disposed in series and comprising a squeezing device, or of padding mangles with a relatively large bath volume. These dyeing vessels or padding mangles are also used for the dyeing of black and colored denim with sulfide or vat dyes. In order to solve color-running problems and in order to achieve an improved dyestuff utilization, it is known that additional units, which consist of a padding mangle with an economizer vat and a subsequent steamer, can be incorporated in warp yarn dyeing machines. These units therefore cannot be used for the main production operation of indigo dyeing.

The known dyeing vessels which comprise a squeezing device or padding mangles, consist of simple roller vats in which the warp to be dyed is impregnated by passing it and deflecting it over a plurality of cylinders or rolls and/or deflection rollers which are located under the level, followed by a squeezing operation. The length of warp under the liquor and thus the residue time in the dye liquor is determined by the number of rolls and deflection rollers under the liquor and their distance from each other. Such a dyeing device is described for instance in EP 0 361 098.

Since the warp speed during indigo dyeing is predetermined and in practice cannot be changed, the time of immersion and the volume of liquor are constant in this case and therefore depend only on the construction of the dyeing vessel.

Greater flexibility is required due to the growing demand for indigo blue materials for jeans with different wash-resistance and different depth of shade, for indigo dyeing of blue or super blue denim, and due to the increasing market share for black and colored denims.

In conventional indigo dyeing installations, for instance different depths of shade require the use of fewer dyeing vessels for lighter hues. Dark hues require a plurality of dyeing vessels disposed in series. Six dyeing vessels each containing up to 2500 l of dyeing liquor, are generally used for a dark shade. This means that conventional indigo dyeing installations have to be reset for the production of different depths of shade. Depending on the desired shade of color, more dyeing vessels have to be used or dyeing vessels have to be eliminated, and dyeing liquors have to be pumped in or pumped off. The dyeing liquor which is not required in the meantime, and which can amount to several thousand liters, has to be drained off or stored for the time being.

In the known loop dye installation, only one dyeing bath is necessary, and the warp yarn band is repeatedly passed therethrough. It is passed through four or five times for dark indigo shades.

In order to reduce their use of dyeing liquor, it has already been proposed to provide a wet dwelling stretch arranged between the immersion bath and the squeezing device, which is arranged in an airtight housing and has an oxygen-poor, respectively oxygen-free atmosphere. Such installations are described for instance in DE OS 43 42 313 and in U.S. Pat. No. 3,981,680.

Shades other than indigo blue are obtained by dyeing with other groups of dyestuffs, mostly sulfide or vat dyes. These and the other groups of cotton dyestuffs, also such as reactive or vat dyestuffs, have different affinities for cotton, which are generally higher than that of indigo. Moreover, their affinities are substantially influenced by the dyeing temperature, which may differ extensively for different groups of dyestuffs. Thus, for example the affinity and dyeing efficiency of indigo increases with decreasing temperature, while for other groups of dyestuffs it mostly increases with increasing temperature.

A higher affinity and dyestuff utilization would be obtained by cooling the indigo dyeing bath in conventional dyeing machines. This is economically disadvantageous, however due to the multiplicity of dyeing vessels and the large amount of dyeing liquor.

Another problem which occurs with the conventional dyeing machines is that the dyestuff is extracted from the dyeing bath due to its affinity. This results in the initial part of the warp yarn band being dyed darker than the end thereof, so that what is termed a head-to-tail progression therefore occurs. This worrying phenomenon, which can manifest itself over several thousand meters of the warp to be dyed, occurs in particular in large installations which contain a large volume of dye bath, and which result in long dyeing runs.

OBJECTS OF THE INVENTION

It is an object of the invention therefore to eliminate the disadvantages of conventional processes for the continuous dyeing of warp yarn, particularly cotton warp yarn, with indigo or other groups of dyestuffs when after impregnation and squeezing-off require oxidation or heat treatment for development and fixing. In particular, an object is to achieve a definite reduction in the amount of dyeing liquor required, and to create economically favorable prerequisites for cooling or heating the dyeing liquor. At the same time, an object is to make it possible for the residence time of the warp yarn band in the dyeing installation to be variable using simple structural means, and for the fixing temperature to be selectable from below room temperature to above 100° C.

An object of the present invention is, therefore, to provide a process for the continuous dyeing of warp yarn, particularly cotton warp yarn, with indigo or other groups of dyestuffs, which makes a high degree of variability possible when dyeing warp yarns with different color shades, and with different groups of dyestuffs also, and to provide an apparatus which effects dyeing under the optimum conditions in each case when using indigo dye, or sulphide or vat dyes according to choice.

SUMMARY OF THE INVENTION

This object is achieved according to the invention by passing a warp yarn band through an air-tight, sealed dyeing reactor which can itself be adjusted to the optimum technological conditions for the respective groups of dyestuffs. For this purpose, the warp yarn band is impregnated in fresh dyeing liquor after an initial immersion and is subsequently squeezed off in an intermediate squeezing device situated in the reactor. Thereafter, the fixing duration is put into effect via guide and deflection rollers with the exclusion of oxygen, with or without repeated immersion in fresh dyeing liquor according to choice, wherein the residence time of the warp threads in the dyeing reactor can be varied corresponding to the desired shade of color and to the technological requirements imposed on the group of dyestuffs concerned.

The dyeing reactor according to the invention is a vessel which is closed at the top and which has openings at its bottom end for the inlet and outlet of the warp yarn band. Vessels for the dyeing liquor, in which the bottom reactor opening is immersed, are disposed under the dyeing reactor. These vessels at the same time form a water lock with guide and deflection rollers which seal the dyeing reactor from the surroundings and by means of which the warp yarn band is fed in and discharged. In addition, a further squeezing device may be disposed in the inlet vat, which squeezes out air which is still contained in the entering warp yarn band. These vessels are equipped with double bottoms by means of which the indigo dyeing liquor can be cooled, or by means of which other dye baths, for example sulphide dyes, can be heated. An intermediate squeezing device is disposed in the dyeing reactor, the squeezing pressure of which can be adjusted in a variable manner down to zero pressure. Instead of the intermediate squeezing device, or in addition thereto, pairs of rollers can be used which strip off excess dyeing liquor when the squeezing device is opened and which thus prevent dyeing liquor from dripping off. The pairs of rollers are adjustable, and are disposed so that the warp yarn band has to follow a more or less pronounced S-shaped curve or a Z-shaped curve. The dwell time of the warp yarn band can be shortened or prolonged, depending on the technological requirements, by guide and deflection rollers which are disposed in the inside of the dyeing reactor and which are vertically displaceable in its interior space.

A hydraulic pipe system for feeding the reactor with dyeing liquors is disposed underneath the dyeing reactor. This circulation system, which consists of feed pipes with pumps disposed therein and of a plurality of valves, is employed for the circulation of the impregnating or dyeing liquor and, when there is a corresponding requirement, for feeding in a feed liquor or higher concentration.

BRIEF DESCRIPTION OF THE DRAWING

Other objects, features, details and advantages of the process according to the invention and of the apparatus according to the invention for carrying out the process follow from the description which is given below with reference to the accompanying drawing, where.

SPECIFIC DESCRIPTION

Figure 1:
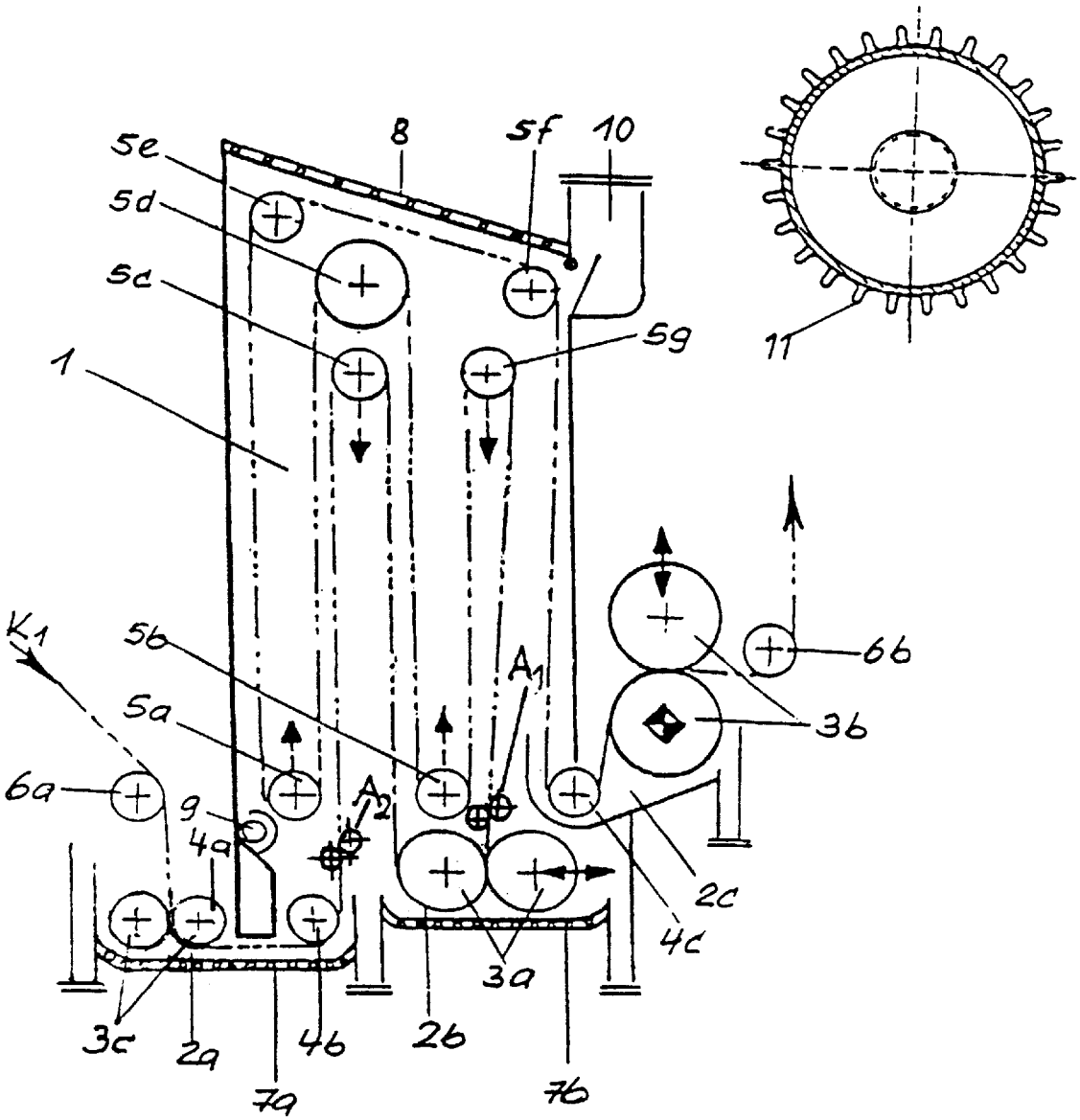
FIG. 1 is a sectional side view of a dyeing reactor.

The dyeing reactor 1 which is illustrated as an example of FIG. 1 is a vessel which is closed at the top. On its bottom side it has three dyestuff vessels 2*a,* 2*b,* 2*c,* which are filled with dyeing liquor. Vessels 2*a* and 2*c* at the same time form water locks, i.e. after filling vessels 2*a* and 2*c* with dyeing liquor the bottom parts of the sidewalls of the dyeing reactor 1 protrude into the dyeing liquor, so that the entry of ambient air, particularly atmospheric oxygen, into the dyeing reactor 1 is prevented. In addition, a squeezing device 3*c,* which squeezes out air which is still contained in the entering warp yarn band, may be disposed in the inlet vat 2*a.* Furthermore, vessels 2*a* and 2*b* have double bottoms 7*a* and 7*b,* by means of which the dyeing liquors can be cooled (for indigo) or heated (e.g. for sulphide dye).

In the dyeing reactor 1 there is an intermediate squeezing device 3*a* which can squeeze off the warp yarn to such an extent that no "liquor heels" occur during the further travel of the warp threads. With this intermediate squeezing device 3*a,* the squeezing pressure on the warp yarn band can be varied down to zero pressure by means of adjustable contact rollers.

Instead of the intermediate squeezing device 3*a,* or in addition thereto, pairs of rollers $A_1$, $A_2$ can be used, which strip off excess dyeing liquor when the squeezing device is opened and thus prevent dyeing liquor from dripping off. The pairs of rollers $A_1$, $A_2$ are adjustable and are arranged so that the warp yarn band has to follow a more or less pronounced S-shaped curved or Z-shaped curve.

Figure 2:
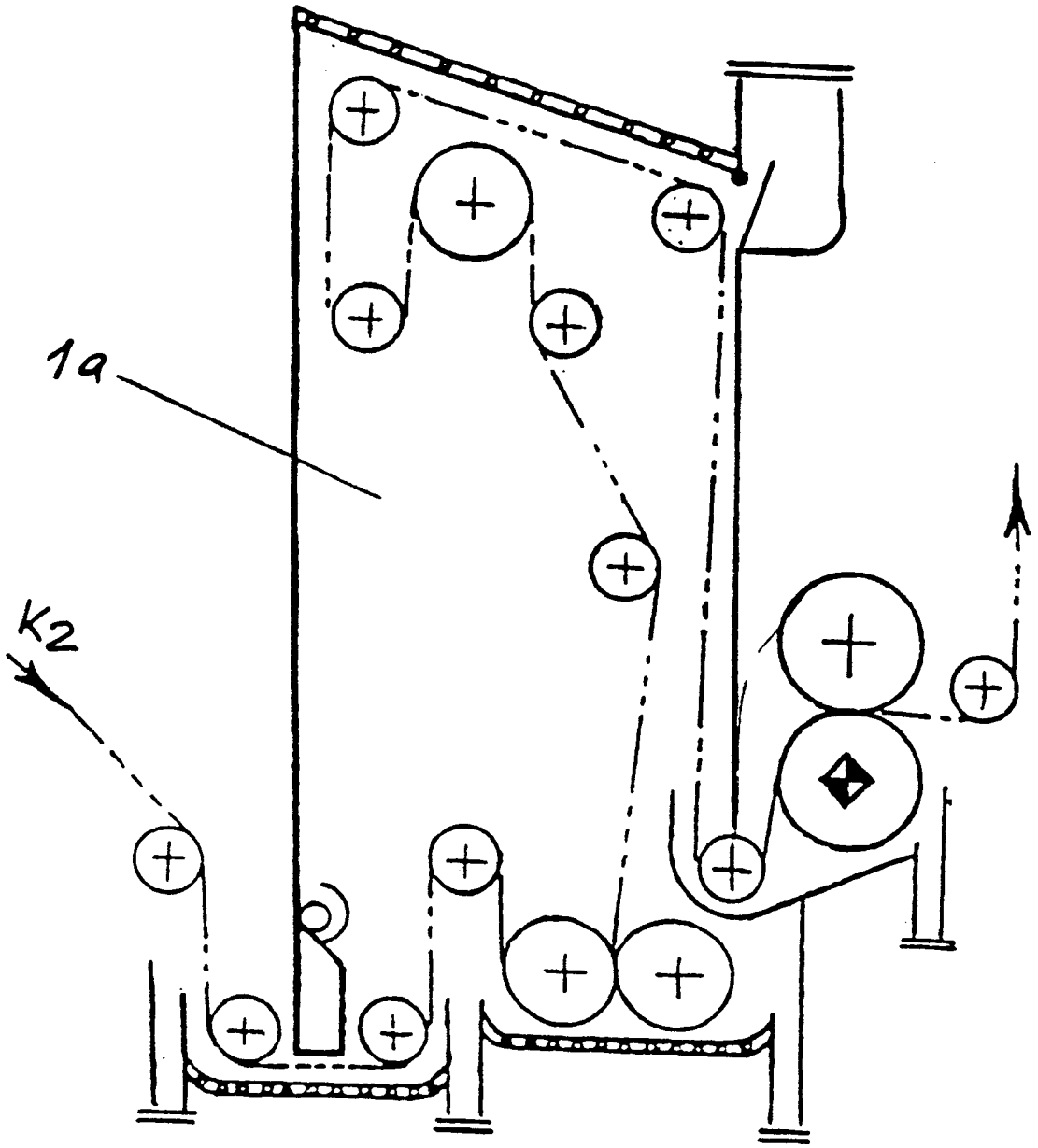
FIG. 2 shows the dyeing reactor according to FIG. 1 with a shortened warp thread intake.

Guide and deflection rollers 4*a,* 4*b,* 4*c* are disposed in the dyeing reactor 1 directly above vessels 2*a* and 2*c.* These are what are termed the submerged rollers of the water locks. The warp yarn band is guided through the dyeing reactor 1 by further guide and deflection rollers 5*a* and 5*g* which are provided in the dyeing reactor. These guide and deflection rollers 5*a* to 5*g* are what are termed ribbed rollers. The ribs 11 of these rollers prevent any possible crossing of the threads. The ribbed rollers remain free from fibers and contamination, due to which thread breaks are prevented. Moreover, these guide and deflection rollers 5*a,* 5*b,* 5*c* and 5*g* are vertically adjustable in the reactor, whereby the warp thread length can be varied. In the example illustrated in FIG. 1, the intake length K1 is 16 m. The example of FIG. 2 illustrates a shortened intake K2, which is 7 m long.

The reactor cover 8 can be heated and is disposed with a diagonal slope so that falling drops are prevented. In addition, the dyeing reactor 1 can be heated by steam, using an annular steam pipe 9.

When hot fixing with steam is employed, e.g. for sulphide dyes, excess steam is discharged through a flue 10. The flue 10 has an overpressure control, i.e. it opens at a certain predetermined steam pressure.

Figure 3:
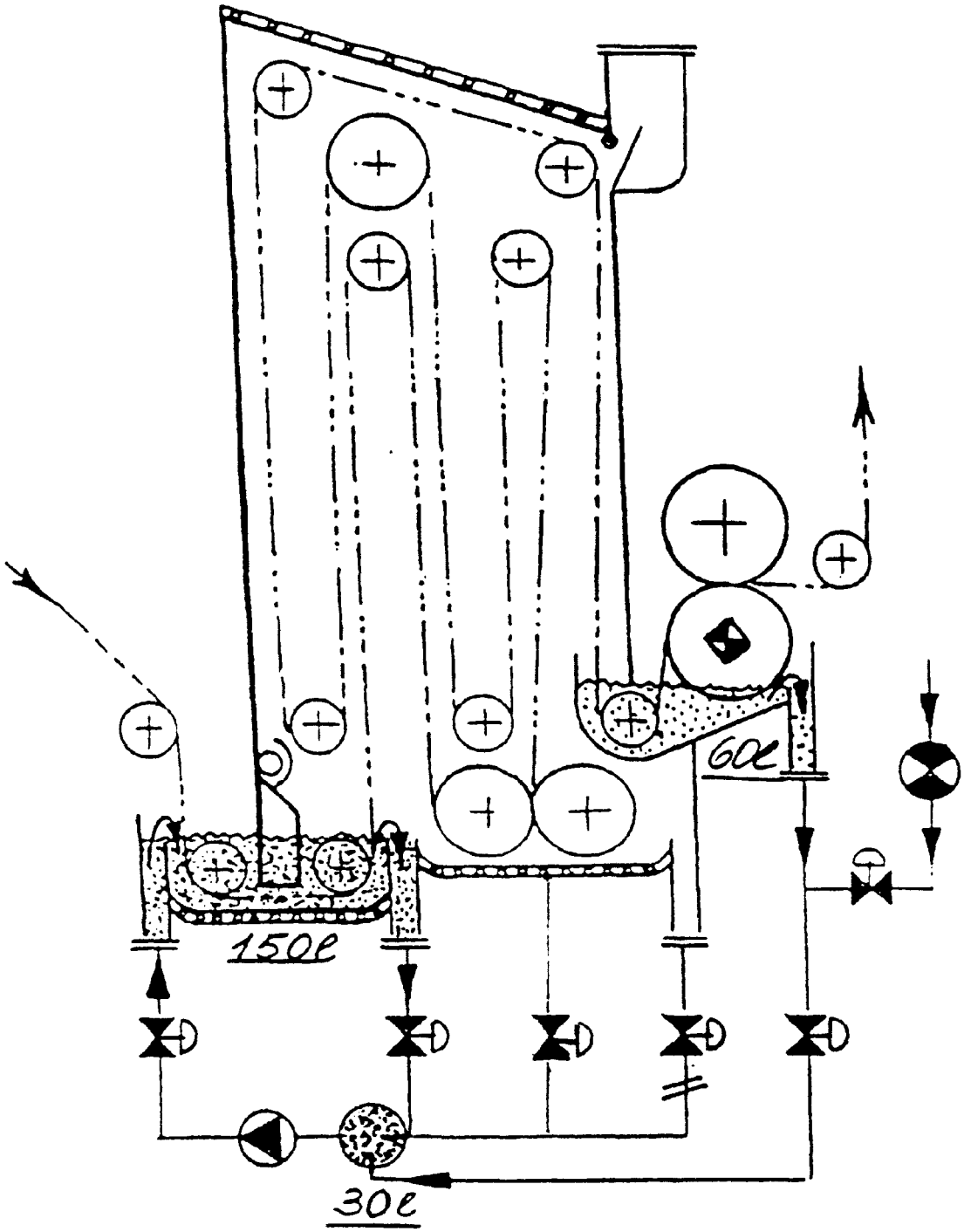
FIG. 3 shows the dyeing reactor according to FIG. 1 when dyeing with the smallest amount of dyeing liquor.
Figure 4:
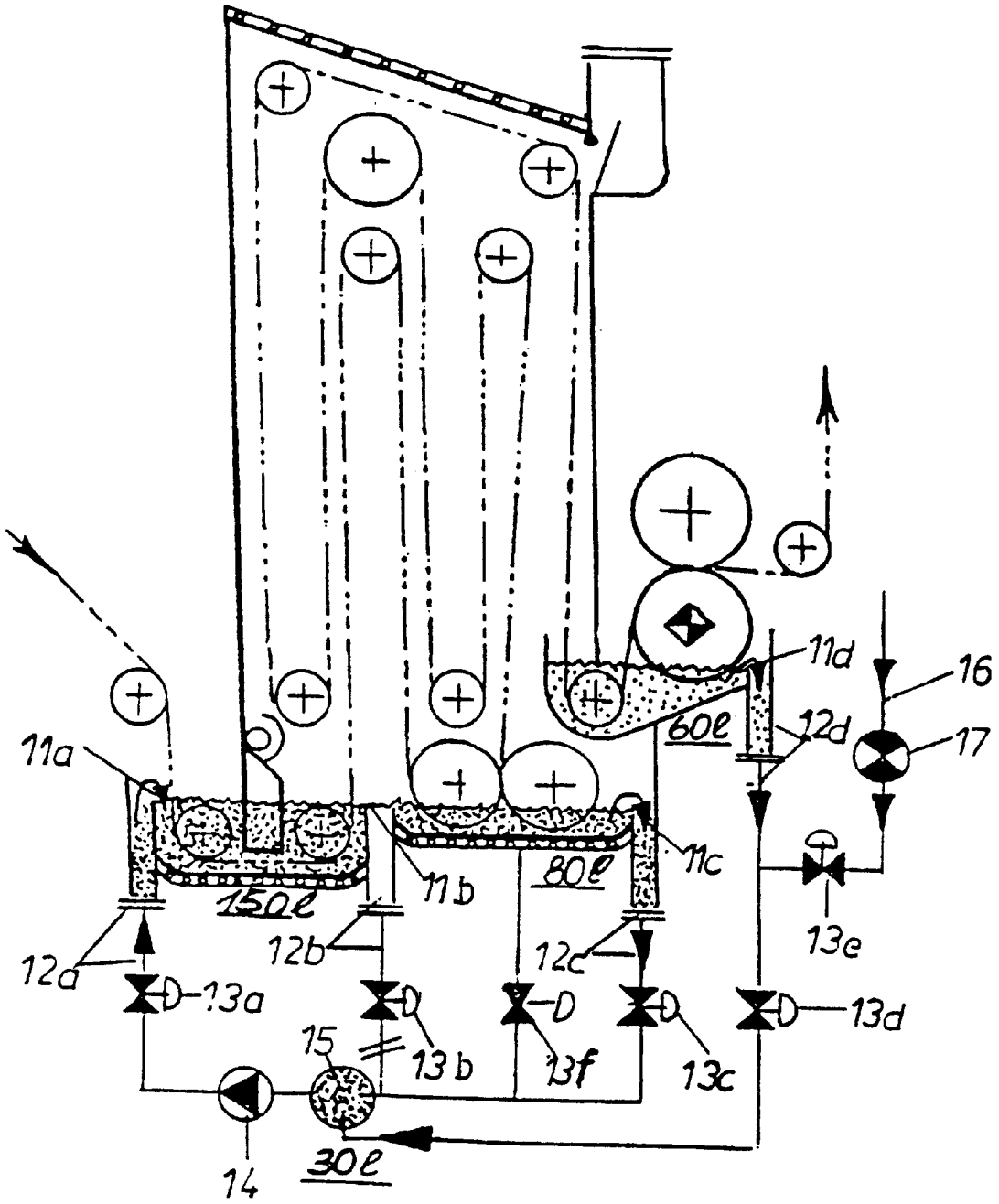
FIG. 4 shows the dyeing reactor according to FIG. 1 when dyeing with the largest amount of dyeing liquor.

FIGS. 3 and 4 illustrate the hydraulic pipe system and the feeding of the reactor with dyeing liquors.

The dyeing liquor is fed in through an inlet 11*a.* Uniformity of the feed dyeing liquor, the concentration of which is higher than that of the impregnating liquor, is ensured by causing it to flow, uniformly over the entire width of the reactor, over a horizontal weir into the first dyeing vessel 2*a.* The volume of dyeing liquor in this first vessel 2*a* is 150 l, for example.

Discharge of the dyeing liquor can be effected according to choice via an overflow 11*b* or an overflow 11*c,* depending on which dyeing vessels contain dyeing liquor in each case. Uniformity of the discharge over the entire width of the reactor is also ensured here by horizonal weirs.

The overflow of the squeezed-off, depleted dyeing liquor from a main squeezing device 3*b* situated outside the dyeing reactor 1 takes place via an outlet 11*d.*

If the small bath volume of 150 1 is selected, circulation of the impregnating or dyeing liquor, which is very important for uniform dyeing, is ensured via a circulation line system 12*a* and 12*b,* comprising a circulation pump 14 which has a variable pump output between 600 and 6000 1/hour. If impregnation in the two dyeing vessels 2*a* and 2*b* is selected, wherein the dyeing liquor volume is 150 l in the first vessel and 80 l in the second vessel, circulation of the liquor is effected via a second circulation system 12*a* and 12*c,* likewise by means of the circulation pump 14.

The selection of the small or large circuit for the dyeing liquors is controlled via valves 13*a,* 13*b* and 13*c*. The valve 13*f* in the discharge pipe prevents the liquor from being concentrated if an empty vessel is selected.

The depleted dyeing liquor from the main squeezing device 3*b* is fed into the dyeing reactor 1 via a further circulation system 12*d* and can be controlled via a valve 13*d*.

The continuously required upgrading of the dyeing liquor with the requisite amount of dyestuff and chemicals in each case to replace those which are entrained by the emerging warp threads is effected by feeding in a feed liquor of higher concentration via an inlet 16, by means of a metering pump 17 which is controlled via the valve 13*e*. This admixing of feed liquor with the two dyeing liquors which are in circulation, namely the circulating liquor and the squeezed-off, depleted liquor from the main squeezing device 3*b,* is effected via a mixing vessel 15 with a liquor volume of 30 l, including pipelines.

Thus in a preferred embodiment, when using the first dyeing vessel 2*a* only the total volume of dyeing liquor involved in the dyeing process is $$150+60+30=240 \text{ l.}$$

When both dyeing vessels 2*a* and 2*b* are charged, the total volume is $$150+80+60+30=320 \text{ l.}$$

Other total volumes of the amount of dyeing liquor to be used are of course possible. Thus a reduction can be achieved, for example, by the use of displacement bodies in the dyeing vessels or an increase can be achieved by raising the inlets and outlets and increasing the liquor level.

Two preferred dyeing processes are described in detail below with reference to examples of embodiments:

EXAMPLE 1

A dyeing liquor with a total volume of 320 l is used for indigo dyeing to produce a standard navy blue shade. An indigo immersion bath containing 3 g/l indigo is used, and the requisite amount of caustic soda and hydrosulphite is added as a reducing agent in order to reduce the dyestuff.

After filling the two dyeing vessels 2*a* and 2*b,* and vessel 2*c* of the main squeezing device 3*b,* the latter at a dilution of 1:1, the dyeing liquor is circulated via the circulation system 12*c* 12*a* and the pump 14.

The valve settings are as follows: valves 13*a,* 13*c,* 13*d* and 13*e* are opened, and valve 13*b* is closed.

By virtue of the large warp intake (16 m), the rate of dyeing can amount to up to 50 m/min, and can be adjusted correspondingly.

In this example, the impregnating liquor is advantageously cooled to 15° C., due to which an affinity of indigo for cotton yarn is substantially increased. Moreover, temperature variations due to the surroundings are kept away from the inside of the dyeing reactor.

The prepared feed liquor comprising 80 g/liter of indigo with the necessary chemicals is supplied in proportion to the weight of warp thread passed through. Control of the metered addition is taken over by a PC, which measures the yardage of warp thread fed in, converts this to weight per unit time (e.g. 18 kg/min) and then meters in the amount of feed liquor in proportion. In this example, 4.5 liters/minute of feed solution is metered in for 2% dyeing at a feed liquor concentration of 80 g/l indigo.

If the longest intake of 16 m is selected, the dyestuff utilization will be the highest possible, and the wash resistance will likewise be the highest possible.

If the smaller intake is selected, the wash resistance will be lower, which may definitely be required of "stone-washed" articles.

EXAMPLE 2

For dyeing black denim or colored denim with a sulphide dye, the procedure is the same in principle as that described in Example 1, except that only the first dyeing vessel 2*a* is employed here, and the total volume is thus reduced to 150+60+30=240 l.

Moreover, the dyeing liquor is heated to at least 90° C. and the interior space of the reactor is heated by steam to 100°–102° C.

The warp thread intake is advantageously 16 m, since the long dwell time ensures the best dyestuff utilization.

What is claimed is:

1. A process for continuous dyeing of warp yarn, comprising the steps of:

(a) feeding a band of parallel unbundled warp yarns between a first pair of squeezing rolls downwardly beneath a lower end of a sealed airtight reactor through a first dyeing vessel filled with a dyeing liquor in which said lower end is immersed;

(b) thereafter passing the band upwardly and downwardly in said reactor over respective rollers including rollers at said lower end of said reactor maintaining a water-lock sealing of said reactor against the exterior;

(c) squeezing said band between a second pair of squeezing rolls at said lower end of said sealed reactor and in a second dyeing vessel and with a variable squeezing pressure;

(d) fixing a color of the dyed band in said reactor above said vessels while passing said band over guide rollers and excluding oxygen from the reactor;

(e) controlling a residence time of said yarn in said reactor to vary a shade of color to be produced without repeated immersion in fresh dyeing liquor; and (f) supplying dyeing liquor at least to said first dyeing vessel with a hydraulic system beneath the reactor.

2. A process for the continuous dyeing of cotton warp yarn, with indigo, sulfide dyes and vat dyes, in which a band of unbundled parallel warp threads is impregnated by passing it through an airtight dyeing reactor comprising one or more dyeing vessels filled with a dyeing liquor for a dwelling time and, in order to prolong the dwelling time, over a plurality of cylinders or rolls and/or deflection rollers which are located in the dyeing liquor, and thereafter squeezing the band of parallel warp threads in a squeezing device, rinsing the band of parallel warp threads, dressing and winding the band of parallel warp threads up on a warp beam, and wherein the warp yarn band is guided so that, after an initial immersion in fresh dyeing liquor, it is impregnated, subsequently squeezed off in an intermediate squeezing device located in the dyeing reactor and thereafter a fixing phase takes place by exclusion of oxygen while the band of parallel warp threads is guided from deflection rollers, without repeated immersion in fresh dyeing liquor, whereby the dwelling time of the warp threads in the dyeing reactor is variable, corresponding to the desired shade of color and a dyestuff used.

3. The process according to claim 2 wherein after entering the dyeing liquor the warp yarn band is immersed in an indigo dyeing liquor with a liquor content of less than 300 l and with a concentration of 3 g/l, after squeezing off in the intermediate squeezing device the concentration in the warp yarn band is reduced to about half, so that during the following dwelling time of the warp yarn band in the reactor a high concentration of 3 g/l which is still present on the warp yarn band can be absorbed on the cotton threads.

4. The process according to claim 2 wherein in indigo dyeing, the liquor is cooled and the dwelling time of the warp yarn band in the dyeing reactor is adjusted in such a way that a maximum dyestuff utilization is achieved and the number of dyeing vessels and the number of immersion-oxidation operations to be repeated is minimized.

5. The processing according to claim 2 wherein in order to save dyestuff a bath concentration in an outlet vessel of the reactor is set low, so that after squeezing of the warp yarn band only a little unfixed dyestuff, which is washed out in a subsequent rinsing bath, is present on the warp yarn band.

6. The processing according to claim 2 wherein to prevent the oxidation of the dyestuff in the airtight dyeing reactor an inert gas is introduced into the reactor.

7. The processing according to claim 2 wherein in order to prevent the oxidation of the dyestuff in the airtight dyeing reactor the air which is present in the entering warp yarn band is squeezed out under the liquor by a squeezing device situated at an inlet of the dyeing reactor.

8. The process according to claim 2 wherein indigo dyeing liquor present in the dyeing vessel is cooled.

9. The process according to claim 2 wherein sulfide dyes or vat dyes present in the dyeing vessels are heated and an interior of the reactor is heated by steam.

10. The process according to claim 2 wherein the squeezing of the warp yarn threads in the intermediate squeezing device is adjusted and discontinued in a variable manner in order to influence dye penetration and wash-resistance.

11. The process according to claim 2 wherein the dyeing liquor is fed to the dyeing reactor uniformer over an inlet a concentration of which dyeing liquor being higher than that of the liquor in said reactor and overflow of squeezed-off and depleted dyeing liquor is effected by a main squeezing device and a weir situated outside the dyeing reactor.

12. The process according to claim 2 wherein the dyeing liquor is continuously upgraded with a requisite amount of dyestuff and chemicals in each case which are removed from the dyeing liquor by the dyeing of the warp thread band by feeding in a feed liquor of higher concentration via an inlet with a metering pump which is controlled by a valve.

13. An apparatus for carrying out the process according to claim 2 wherein the dyeing reactor is a vessel which is closed at a top thereof, the vessel having a bottom end forming a reactor base, the vessels protruding beyond a sidewall to form a water lock, the apparatus comprising guide and deflection rollers which have a sealing effect sealing the reactor from surroundings adapted for the feeding and discharge of the warp yarn band, an intermediate squeezing device, the squeezing pressure of which can be adjusted in a variable manner down to zero pressure, being disposed in the dyeing reactor together with, as guide and deflection rollers, a hydraulic pipe system for feeding the reactor with dyeing liquors being disposed underneath the dyeing reactor.

14. An apparatus according to claim 13 wherein the guide and deflection rollers are vertically displaceably disposed in the dyeing reactor for lengthening or shortening the warp yarn band.

15. An apparatus according to claim 13 wherein the guide and deflection rollers are constructed as ribbed rollers.

16. An apparatus according to claim 13 wherein in order to strip off excess dyeing liquor adjustable pairs of rollers comprising teflon-coated rods are disposed in the dyeing reactor.

17. An apparatus according to claim 13 wherein a bottom of the vessel for the dyeing liquor is constructed so that the vessel can be heated and cooled.

18. An apparatus according to claim 13 wherein a top closure of the dyeing reactor is provided and is of diagonally sloping construction and can be heated, and wherein an annular steam pipe is provided for heating the interior space of the dyeing reactor.

19. An apparatus according to claim 13 wherein the dyeing reactor is equipped with a flue with an overpressure control.

20. An apparatus according to claim 13 wherein the hydraulic pipe system for feeding the reactor is provided for the circulation of the impregnating or dyeing liquor and consists of feed pipes with a pump disposed therein and of valves, and a metering pump for feeding in a feed liquor of higher concentration and disposed in an inlet comprising a valve.

21. An apparatus according to claim 13 wherein horizontal weirs are disposed in an inlet and at outlets of the reactor in order to ensure uniformity of the dyeing liquor over the entire width of the reactor.

* * * * *